US005488909A

United States Patent [19]

Moser

[11] Patent Number: 5,488,909

[45] Date of Patent: Feb. 6, 1996

[54] SHORT RANGE PROJECTILE

[75] Inventor: Franz Moser, Hirtenberg, Austria

[73] Assignee: Hirtenberger Aktiengesellschaft, Hirtenberg, Austria

[21] Appl. No.: 103,011

[22] Filed: Aug. 6, 1993

Related U.S. Application Data

[63] Continuation-in-part of Ser. No. 938,747, Sep. 2, 1992, abandoned.

[30] Foreign Application Priority Data

Nov. 20, 1991 [AT] Austria ..... 2310/91

[51] Int. Cl.[6] ..... F42B 8/12

[52] U.S. Cl. ..... 102/529; 102/514

[58] Field of Search ..... 102/444, 501, 102/502, 506–510, 514–517, 529

[56] References Cited

U.S. PATENT DOCUMENTS

| | | | |
|---|---|---|---|
| 3,326,133 | 6/1967 | Stadler et al. | 102/529 |
| 4,108,074 | 8/1978 | Billing, Jr. et al. | 102/529 |
| 4,336,756 | 6/1982 | Schreiber | 102/516 |
| 4,503,777 | 3/1985 | Young | 102/514 |
| 4,805,536 | 2/1989 | Kosteck | 102/514 |
| 5,012,743 | 5/1991 | Denis et al. | 102/514 |
| 5,069,139 | 12/1991 | Denis | 102/516 |
| 5,183,963 | 2/1993 | Beaufils et al. | 102/515 |

FOREIGN PATENT DOCUMENTS

| | | | |
|---|---|---|---|
| 1292252 | 3/1962 | France | 102/514 |
| 2662789 | 12/1991 | France | 102/529 |
| 1007227 | 10/1965 | United Kingdom | 102/501 |

*Primary Examiner*—Harold J. Tudor
*Attorney, Agent, or Firm*—Anderson Kill Olick & Oshinsky

[57] ABSTRACT

A short range projectile includes a metal jacket, which surrounds a plastic material core and has an external diameter up to about 0.4% larger than the diameter of a normal projectile of the caliber involved and an axial length of about 2 to 3.5 times the diameter of the projectile.

4 Claims, 1 Drawing Sheet

SHORT RANGE PROJECTILE

FIELD OF THE INVENTION

This is a continuation-in-part of U.S. patent application Ser. No. 07/938,747, filed Sep. 2, 1992, and entitled "Short Range Cartridge".

The present invention generally concerns ammunition and more particularly deals with a short projectile.

BACKGROUND OF THE INVENTION

Short range projectiles which serve, e.g., as practice ammunition, are known. Such projectiles should have all the functions of standard ammunition (such as continuous firing) and enable the shooter to achieve realistic aiming, sighting and firing over a predetermined short distance (e.g., 100 m.), but have a considerably shorter range than that of standard ammunition.

The demand for realistic, aiming, sighting and shooting however compels the meeting of contradictory requirements for short range projectiles. The projectile should be as light as possible to have a short range, but must have specific minimum dimensions, mass and a sufficient quantity of powder to enable the weapon (particularly if it is an automatic weapon) to function properly.

Projectiles made of plastic materials, which may contain metallic inclusions for proper weight matching, have therefore been proposed. Such projectiles however become heated and melt after several shots are fired in short bursts once the firearm becomes heated. The melting, in turn, could lead to jamming and possibly even damage to the firearm (or worse dangers). Such projectiles also permit propellant gases to slip by with ease between the bore and the easily deformable plastic material projectile and lead to erosion of the barrel.

Another proposal is to employ a metal blank with a plastic material core. The low mass of this projectiles however necessitates a change in the firearm if the automatic functions of the weapon are to be maintained.

It is therefore an object of the present invention to provide a short range projectile which is light and yet has sufficient dimension, mass and quantity of powder.

Another object of the invention is to provide a short range projectile which reduces the risk of propellant gases slipping between the bore and the plastic material projectile, whereby the erosion of the barrel is prevented.

A further object of the invention is to provide a short range projectile which does not necessitate a change in the firearm if the automatic functions of the weapon are to be maintained.

A further object of the invention is to provide a short range projectile where the function of the weapon (automatic reloading with gas pressure operated loader) is assured just as is the case with standard ammunition.

SUMMARY OF THE INVENTION

These and other objects of the invention, which shall become apparent hereafter, are achieved by the present short range projectile comprising a metal jacket with a plastics material core, where the external diameter of the metal jacket is about 0.4% larger than the diameter of a normal bullet of the caliber involved, and the axial length of the jacket is about 2 to 3.5 times that of the diameter.

A projectile according to the present invention has internal ballistics which largely coincide with those of a normal projectile. The formation of a gap or clearance between the bullet and the inside of the barrel is avoided by the increase in diameter so that neither erosion phenomena nor loss of the automatic function of the firearm occur. The attainable moment of inertia of the projectile also assists in this. Due to the plastic material body, which is offset from the bore inner wall, the disadvantageous adhesion and corrosion, as they frequently occur in the present state of the art projectiles are avoided.

BRIEF DESCRIPTION OF THE DRAWINGS

The invention will be better understood by the Detailed Description of the Preferred Embodiment, when read in conjunction with the accompanying drawings, wherein.

DETAILED DESCRIPTION OF THE PREFERRED EMBODIMENTS

Figure 1:
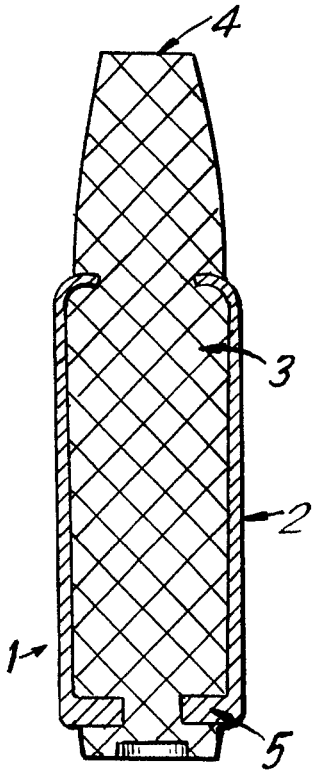
FIG. 1 is a longitudinal, cross-sectional view of a short range projectile according to the present invention.

Referring to the drawings, wherein like numerals designate like elements, throughout the several view, FIG. 1 shows a short range projectile 1 according to the invention, having a plastic material core 3 and a metal jacket 2. The external diameter of the metal jacket 2 is about 0.3 to 0.4% larger than the external diameter of a round or projectile normally used for a predetermined caliber, and the axial length of the metal jacket amounts to 2 to 3.5 times the diameter of the projectile. The inside of the jacket is provided, in a preferred embodiment, with essentially axial notches or a polygonal section for better anchoring the plastic material core. The wall thickness of the metal jacket is preferably larger in the bow region than in the tip region in order to move the center of gravity rearward in a favorable manner.

The projectiles of the invention are mainly intended for the calibers of 5.56 mm and 7.62 mm. For calibers of 5.56 mm, the maximum dimension of the diameter permissible according to the standard is 5.70 mm. A projectile of this caliber has preferably an external diameter of 5.74–5.76 mm. For calibers of 7.62 mm, the permissible maximum dimension for the diameter according to the standard is 7.83 mm. A projectile of this caliber has, in the invention, in actual practice, an external diameter of 7.86–7.87 mm.

Because of the large diameter of the inventive projectiles in connection with the specific axial length of the metal jacket, the cartridge is propelled forward in the barrel with sufficient slowness and tightness by the friction to assure automatic reloading with gas pressure operated loader.

The external diameter of the plastic material core 2 is smaller everywhere than the barrel diameter of the caliber so that the plastic material does not come into contact with the inner wall of the firearm barrel or portions of the breech block. A shock-resistant, high-strength and temperature-resistant plastic material, such as a polyamide, which can be injection-molded or extruded, can be used as the core material. Good results were obtained with a plastic material commercially available under the tradename "ULTRAMID B4K". An electrically conductive plastic material can be used in one version so as to make possible an automatic hit indication when electronic targeting display devices are used. Brass can be used for the metal jacket.

The tip 4 of the projectile is flattened. The wall thickness of the jacket 2 decreases from the base 5 of the projectile toward the tip 4. This configuration causes the center of gravity of the projectile to move towards the base 5.

Tests have shown that the projectile according to the invention can remain, as long as necessary, in the loading chamber of a weapon heated by firing, without initial melting or adhesion. In a preferred embodiment, the weight of the projectile is kept between 30 to 50% of the weight of normally used bullets of the caliber involved by appropriate selection of the wall thickness or the length of the metal jacket.

Figure 2:
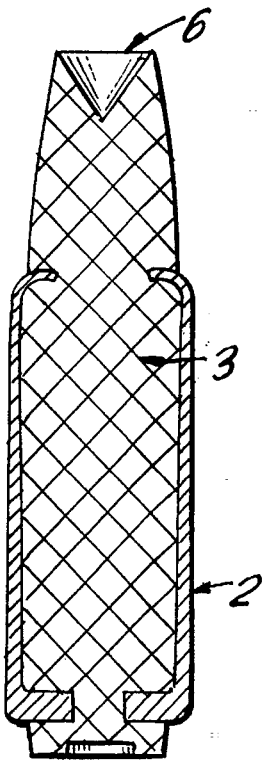
FIGS. 2 and 3 are longitudinal cross-sectional views of alternate embodiments of the invention.

In the embodiment of a projectile according to the present invention, which is shown in FIG. 2, the main difference, compared to the projectile in FIG. 1, lies in the configuration of the tip 6. Here, the tip 6 has, at its end surface, a cone-shaped recess, which can also be truncated or a spherically-shaped recess may be provided. A flat, cone-shaped or truncated-cone-shaped recess results in destabilization of the altitude of the projectile while in flight, especially if the center of gravity of the projectile is located towards the rear.

Another difference is the more pronounced taper of the wall thickness of the jacket 2 toward the tip 6 of the projectile. Naturally, this projectile, compared to the normal projectile, also comprises the increased external diameter of the jacket 2. The external diameter of the plastic material core 3 is also selected so that it does not touch the inner wall of the barrel and the walls of the loading chamber when the shot is fired. By a combination of these measures, the safety zone of the projectile can be reduced to one-third and, in some cases, to even to one-fourth of the safety zone of normal ammunition.

Figure 3:
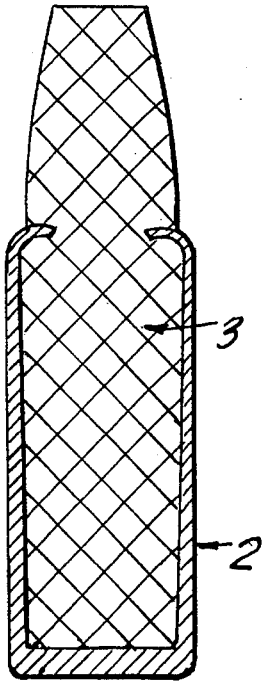

In the projectile shown in FIG. 3, the metal jacket 2 forms a continuous base.

While the invention has been shown and described with reference to the preferred embodiments of the invention, variations and adaptations may be made thereto, without departing from the spirit and scope of the invention as defined in the following claims:

What is claimed is:

1. A short range projectile for use with a firearm having a caliber selected from the group consisting of 7.62 mm and 5.56 mm, said projectile comprising:

a plastic material core having a tip; and a metal jacket at least partially surrounding the core and having an external diameter of 7.86– 7.87 mm for the 7.62 mm caliber and of 5.74–5.76 mm for the 5.56 mm caliber and an axial length about 2 to 3.5 times the external diameter of the metal jacket of the short range projectile.

2. The short range projectile of claim 1, wherein the tip is substantially flat.

3. The short range projectile of claim 1, wherein the tip has a cone-shaped recess.

4. The short range projectile of claim 1, wherein the metal jacket has a wall having a thickness which is larger in a bow region than in a tip region, whereby center of gravity is towards the rear.

* * * * *